US005691702A

United States Patent [19]

Hay

[11] Patent Number: 5,691,702

[45] Date of Patent: Nov. 25, 1997

[54] PNEUMATIC PRESSURE DETECTOR FOR FIRE AND GROUND FAULT DETECTION

[75] Inventor: Wayne R. Hay, Pleasant Hill, Calif.

[73] Assignee: Whittaker Corporation, Concord, Calif.

[21] Appl. No.: 525,190

[22] Filed: Sep. 8, 1995

[51] Int. Cl.[6] ..... G08B 21/00

[52] U.S. Cl. ..... 340/626; 340/592; 200/81.4; 73/204.13

[58] Field of Search ..... 340/626, 592; 73/40.5 R, 204.13; 200/83 N, 81.4; 236/DIG. 11; 60/527

[56] References Cited

U.S. PATENT DOCUMENTS

| | | | |
|---|---|---|---|
| 3,195,121 | 7/1965 | Lindberg, Jr. | 340/592 |
| 3,234,537 | 2/1966 | Lindberg | 340/592 |
| 3,594,745 | 7/1971 | Nickels | 340/626 |
| 3,786,210 | 1/1974 | Byam | 200/81.4 |
| 3,896,423 | 7/1975 | Lindberg | 340/592 |
| 4,591,677 | 5/1986 | Hirota et al. | 200/81.4 |
| 5,136,278 | 8/1992 | Watson et al. | 340/626 |

*Primary Examiner*—Jeffery Hofsass
*Assistant Examiner*—John Tweel, Jr.
*Attorney, Agent, or Firm*—Henry M. Bissell

[57] ABSTRACT

Electrical circuitry associated with a pneumatic pressure detector for use in an overheat condition or fire alarm system for aircraft. The pressure detector comprises a plenum situated between a pair of deformable diaphragms and pressurized by a capillary type sensor containing an absorbed gas. A control electronics stage is located remotely from the pressure detector stage and is connected thereto by a single wire extending between them. The control electronics stage senses integrity failure of the pressure detector, an overheat or fire condition, and a ground fault in the connection between the two stages and provides corresponding output indications. The circuitry also includes ground connections at the control electronics stage and the pressure detector, respectively.

21 Claims, 3 Drawing Sheets

PNEUMATIC PRESSURE DETECTOR FOR FIRE AND GROUND FAULT DETECTION

BACKGROUND OF THE INVENTION

1. Field of the Invention

The present invention is directed to a pneumatic pressure detector and, more specifically, to a detector for use in a fire alarm system having a sensor tube pressurized with a gas. The system uses a simplified circuit to achieve fire detection and identification of a ground fault.

2. Description of Related Art

One particular type of fire alarm system which is well-known in the prior art is schematically illustrated in FIGS. 1 and 2 of the accompanying drawings. In such a system, as illustrated by the dashed outline, there is a responder assembly 10 and a sensor tube 11. The sensor tube 11 may be several feet long and is placed in the compartment of an aircraft where fire or overheat conditions are to be detected. The sensor tube is shown in enlarged detail in FIG. 2 and includes a core element 12 which stores hydrogen gas and is spiral wrapped to allow a gas path in the event of sensor damage such as crushing or kinking. In that event, the wall 13 encloses the core but has sealed in pressurized helium gas.

The responder assembly 10 to which sensor tube 11 is connected basically has a gastight plenum 15 to which capillary tube 11 is connected. In a prior fire detector system sold as a Model 801-DRH by Systron Donner Corporation of Concord, Calif., plenum 15 was actually formed of two separate switches. Each responder assembly contains both an alarm switch 14 and an integrity switch 16. The alarm switch 14 which is normally opened would close in response to an overheat or fire condition. This would be caused by an increase in gas pressure in tube 11 which would force the diaphragm 17 against the contact designated 1. Similarly, if the sensor tube 11 was cut, which would release its gas pressure, the diaphragm 18 which is normally closed against the contact designated 3 would open, signifying failure of the system.

The remainder of the detector includes electrical circuitry connected to terminal 1 to provide a 28-volt DC voltage, terminal 2 which is connected to metallic diaphragms 17 and 18 to provide an alarm signal whenever one switch closes and the other switch opens, and terminal 3 which is a system test. The diaphragm switches 14 and 16 controlled by a sensor tube 11 are generally disclosed in one of many Lindberg, Jr. patents, a typical one of which is U.S. Pat. No. 3,122,728.

In operation in general, ambient helium gas pressure in the sensor tube 11 is directly related to average temperature in, for example, an engine compartment of an airplane. Engine compartment overheat causes a proportionate rise in gas pressure. When the compartment temperature rises to the factory set alarm rating, the rising gas pressure closes the sensor alarm switch 14. When compartment cooling reduces the gas pressure, the alarm switch opens and is ready to respond again. For indication of an actual fire rather than overheat conditions, hydrogen gas in the core 12 (FIG. 2) is released to close the alarm switch. Lastly when the sensor tube 11 is cut, the helium gas escapes and the integrity switch 16 opens.

To structurally implement the showing of FIG. 1, the above-mentioned detector Model 801-DRH utilized two separate side-by-side responder assemblies, each including its own separate plenum and diaphragm switch, which then were connected to a common sensor tube.

Since this detector is for aircraft applications, minimization of both weight and size is important.

An improved pneumatic detector for use in an overheat or fire alarm system corresponding to that of the prior art system illustrated in FIGS. 1 and 2 is the subject of U.S. Pat. No. 5,136,278 of Nigel S. Watson and Shailer T. Pickton, also assigned to Systron Donner Corporation. The entire disclosure of U.S. Pat. No. 5,136,278 is incorporated herein by reference as though set out in haec verba. In brief, the embodiments disclosed in that patent provide the equivalent of the two switches 14 and 16 in an integral unit in which first and second deformable diaphragms are mounted to alternatively connect to corresponding electrical circuit contacts. The deformable diaphragms are installed in the integral switch unit on opposite sides of a central plenum to which a sensor tube 11 is connected.

FIGS. 1–5 of the accompanying drawing are taken from the '278 patent. The improved embodiment thereof is illustrated in FIGS. 3, 4 and 5. Briefly, as described in further detail in the '278 patent, the responder assembly of FIG. 4 corresponds to the responder assembly 10 of FIG. 1. It shows a substantially cylindrical container 21 having an axis which is coincident with conductors 1 and 3. One end of the container 21 is formed by the disc 22 which carries deformable circular diaphragm 17 which is brazed at its periphery to the disc 22. The other end of the container 21 comprises a disc 23 carrying deformable diaphragm 18. This structure, together with apertured center plate 24 and the annular rings 26 and 27, defines a central plenum between the diaphragms 17, 18 which communicates with the sensor tube 11.

Associated with the conductors 1 and 3 in the assembly of FIG. 4 are sealed off capillary sensors in the form of tubes shown at 28 and (schematically) at 29. These apply pressure to the other sides of the diaphragms 17 and 18 which are remote from the central plenum coupled to the sensor tube 11. These tubes 28 and 29 form in effect second and third plenums for the purpose of normalization of ambient conditions and/or to serve as a reference standard. It will be understood that the conductor 3 runs through the end housing 32.

The alternate embodiment which is depicted in FIG. 5 provides a central spacer 33 having a double T-shaped configuration in cross section. This is provided instead of the three-part spacers 26, 27 which are shown between the end plates 22 and 23 of the FIG. 4 embodiment. The embodiment of FIG. 5 requires brazing at only two locations, rather than four as in the embodiment of FIG. 4.

Finally, another circuit of the prior art, one which is presently in use, achieves the equivalent functions of the assemblies shown in FIGS. 1–5 in an improved arrangement which does away with the requirement for the conductor No. 3 extending from outside the module to contact the normally closed deformable diaphragm 18 in the circuit of FIG. 1. This circuit is depicted schematically in FIG. 6 and is shown comprising the same diaphragm elements 17 (normally open) and 18 (normally closed) represented in the schematic diagram of FIG. 1. The structure of the pneumatic sensor detector 62 is much like the construction depicted in the sectional views of FIGS. 4 and 5. The two deformable diaphragms 17 and 18 are brazed about their peripheries to the housing and are adapted to make electrical contact with the elements 58 of the normally open alarm switch 14 and 60 of the normally closed integrity switch 16. A first conductor 52 extends between a control electronics block 56 and the contact 58 while the contact 60 is coupled through a resistor R to the conductor 52. A second conductor 54 extends from the control electronics block 56 to make contact with both deformable diaphragms 17, 18 within a housing 62. The control electronics block 56 also has a ground connection 64 which connects to the aircraft frame or other ground conductor of the aircraft in which the sensor system is installed.

It will be noted that in the prior art embodiments of FIGS. 1–5 as disclosed in the '278 patent, three electrical conductors are required. Conductor No. 2 provides a common connection to the housing which makes electrical contact through the brazed connections to the respective deformable diaphragms 17 and 18. Conductor No. 1 provides the connection to the normally open switch 14 comprising the deformable diaphragm 17. Conductor No. 3 provides the connection to the normally closed switch 16 comprising deformable diaphragm 18.

In the prior art embodiment of FIG. 6, effective operation of the sensor assembly is achieved with only two conductors extending from the control electronics block 56 to the switch assembly within the housing 62. In that circuit, opening both of the alarm and integrity switches 14, 16 results in an open circuit between the first and second conductors 52, 54. If the alarm switch 14 is closed, regardless of the position of the integrity switch 16, the resistance between the first and second conductors 52, 54 equals zero. If the integrity switch 16 is closed while the alarm switch 14 is open, the resistance between the first and second conductors 52, 54, equals the value of the resistance element R which can readily be sensed in the control electronics block 56. The control electronics circuitry in block 56 is capable of responding to a value of resistance R across the first and second conductors 52, 54 and differentiating that reading from detection of either an open circuit or a short circuit across the conductors 52, 54 to develop signals corresponding to the various switch conditions described.

SUMMARY OF THE INVENTION

A sensor circuit arrangement in accordance with the present invention is capable of providing the desired signals for interpretation of sensor switch conditions in a circuit configuration which uses only one wire between the control electronics and the switch assembly. A second circuit path between the two major components of the system is provided by way of the ground path which is established by having a ground connection at the control electronics block and another ground connection at the sensor assembly block. Completion of this circuit path is effected by way of the common grounding path in the aircraft.

As with the prior art circuit of FIG. 6, one arrangement of the sensor assembly of the invention includes a normally open alarm switch and a normally closed integrity switch, both being of the diaphragm type shown in the embodiments of FIGS. 4 and 5, for example. The diaphragms of the two switches are connected, as indicated, to the housing of the diaphragm assembly by brazing. This arrangement forms a module comprising the two switches, each including a contact and deformable diaphragm, a plenum chamber between the diaphragms, and a coupling for the sensor tube, all within a sealed housing. The module has two external terminals, one for each contact, not counting any connection to the housing. The sensor assembly circuit includes first and second resistors directly connected respectively to the contact terminals. However, the first resistor is also connected to the second terminal where the second resistor is connected. Thus the first resistor provides a resistive circuit path between the first and second terminals of the sensor assembly module (and thus between the two contacts inside the module).

In another arrangement of the sensor assembly of the invention, two separate switch-and-plenum assemblies are provided, as in the Systron Donner Model 801-DRH unit described hereinabove. The two switch contacts of the individual switch-and-plenum assemblies are interconnected in electrical circuitry equivalent to that described for the first arrangement to perform in similar fashion. The separate plenum modules are grounded to the external housing in the manner of the first-mentioned arrangement and performs equivalently thereto.

The sensor circuit module and interconnected resistors are installed within an outer container which has a single external terminal to which the remote end of the second resistor is connected. The container also provides for insertion of the sensor tube to the coupling leading through the module housing. Finally, there is an electrical connection from the container (which is of a conducting metal) to ground. A remote control electronics unit has a single lead, coupling to the external terminal of the container, which constitutes the only direct electrical connection between the control electronics and the housing containing the sensor assembly module. A sensor circuit return path is provided through the ground connections at the control electronics block and the sensor assembly, respectively. This arrangement in accordance with the present invention not only eliminates the need for a second wire extending between the control electronics block and the sensor assembly, but it also provides an additional capability of detecting a ground fault anywhere along the wire extending between the two remote sections of the sensor circuit, since there is now an additional level of resistance capable of detection by the control electronics stage in this embodiment.

A ground fault results in a short circuit between the sensor wire and ground. For both switches open, the sensor module presents an open circuit. For both switches closed, only the second resistance is in the sensor circuit, whereas with the alarm switch open and integrity switch closed, both resistors are in series across the control electronics terminal to ground.

In still another arrangement in accordance with the present invention, three separate switches are provided in a single outer housing, each being connected to a common manifold coupled to a heat sensor. The first of the three switches is an integrity switch which, as with the integrity switch for the other arrangements, is held closed by normal sensor pressure. It opens to develop an alarm signal in the event that the sensor tube is breached. A second switch functions as an overheat switch which is normally open. This closes upon the sensor reaching a temperature of 450° F. or above to provide an alarm signal indicating an engine overheat condition. A third switch, also normally open, is provided to develop an alarm indicating the presence of fire. This switch closes when the sensor indicates detection of a temperature of 650° F. or above.

BRIEF DESCRIPTION OF THE DRAWING

A better understanding of the present invention may be realized from a consideration of the following detailed description, taken in conjunction with the accompanying drawing in which.

DESCRIPTION OF THE PREFERRED EMBODIMENTS

Figure 7:
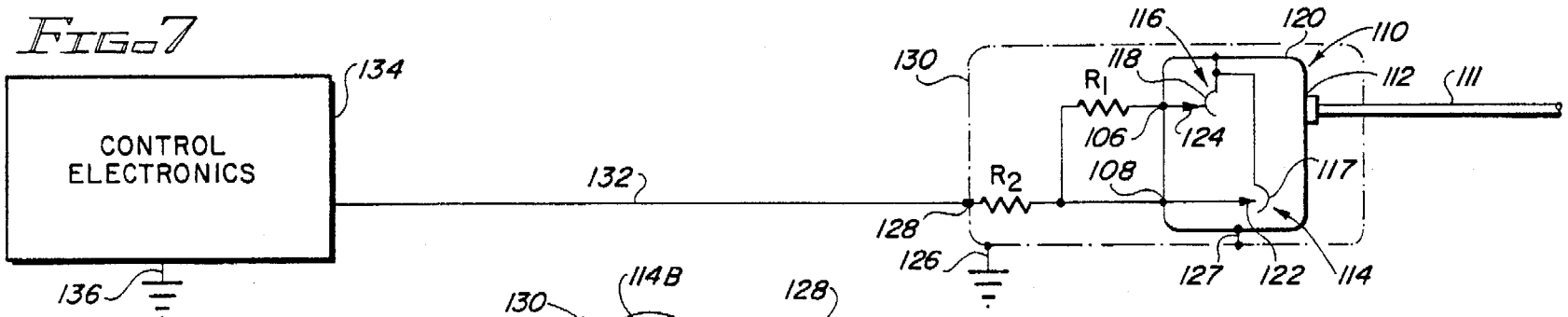
FIG. 7 is a schematic diagram illustrating a detector in accordance with the present invention.

One preferred embodiment of the present invention is schematically represented in FIG. 7. This shows a sensor assembly module 110 of a type of construction already described, containing a normally open sensor alarm switch 114 and a normally closed integrity switch 116. The two switches include deformable diaphragms electrically connected together and to the module housing 120. Alarm switch 114 comprises the diaphragm 117 and contact 122. The integrity switch 116 comprises the diaphragm 118 and contact 124. A pneumatic coupling 112 is provided for coupling the sensor tube 111 into the module housing 120 and to the plenum formed between the two diaphragms.

The module 110 is provided with two external terminals 106, 108. Terminal 106 is connected to the contact 124; terminal 108 is connected to the contact 122.

The module 110 is mounted within an outer container or housing 130 which has a single external terminal 128. An associated control electronics stage 134 is provided to receive, process and indicate signal conditions which are present within the sensor assembly module 110. A single connecting lead extends from the control electronics stage 134 to the external terminal 128.

There are two resistors $R_1$ and $R_2$ within the container 130 which are connected to the terminals of the sensor assembly module 110. First resister $R_1$ is electrically connected between terminals 106 and 108. Second resistor $R_2$ is also connected to the terminal 108 of the module 110 and extends to the external terminal 128 of the housing 130. There is a separate ground connection for each of the two remote interconnected modules, number 136 for the control electronics stage 134 and number 126 for the container housing 130 which is constructed of a conducting metal; for example, stainless steel or plated copper or the like. There is also an electrical connection between the metal housing 120 of the module 110 and the housing of the container 130.

The arrangement of FIG. 7 provides the capability of detecting four different circuit conditions for which the control electronics stage 134 can provide different indications. With the switches 114 and 116 in the conditions illustrated in FIG. 7 (114 open and 116 closed), both resistors $R_1$ and $R_2$ are in series circuit from terminal 128 to the ground connection 126. This is interpreted as the normal indication for the circuit arrangement, the integrity switch 116 providing assurance that conditions are normal. Should the switch 116 open by the movement of the diaphragm 118 away from the contact 124, the path to the control electronics 134 between the wire 132 and the ground 136 goes to open circuit, indicating that the integrity of the sensor is no longer valid. This condition is experienced if there is a rupture in the sensor tube 111.

Should the engine compartment or other space in the aircraft being monitored experience overheat or fire conditions, the gas in the sensor tube 111 expands, thereby driving the diaphragm 117 to close the alarm switch 114. This shorts out the resistance $R_1$, leaving only the second resistor $R_2$ in the loop between the lead 132 and the ground connection 136. The resistances of $R_1$ and $R_2$ and the sensitivity of the control electronics stage 134 are such that the control electronics 134 can distinguish between the series resistance of $R_1$ and $R_2$, the single resistance $R_2$, a short circuit from the lead 132 to ground, and an open circuit. Thus the circuit configuration of the present invention not only provides additional simplicity with respect to the use of only a single wire between the control electronics 134 and the container 130 housing the sensor assembly module 110, but it provides the additional capability of detecting a ground fault, as when the lead 132 shorts to ground. This establishes a simpler, more economical sensor configuration with additional circuit reliability than has heretofore been available.

It will be understood that the sensor switch circuitry of FIG. 7, which has been described heretofore in the context of a unitary switch assembly module 110, may just as well utilize two separate switches for the alarm switch 114 and the integrity switch 116. Each such separate switch would have a contact and deformable diaphragm within its own individual module housing in the manner of the Systron Donner Model 801-DRH unit, the housings being connected together to the sensor tube so that the function and result described for the embodiment represented in FIG. 7 would be achieved. Such a switch is shown schematically in FIG. 10 and described hereinafter.

Figure 8:
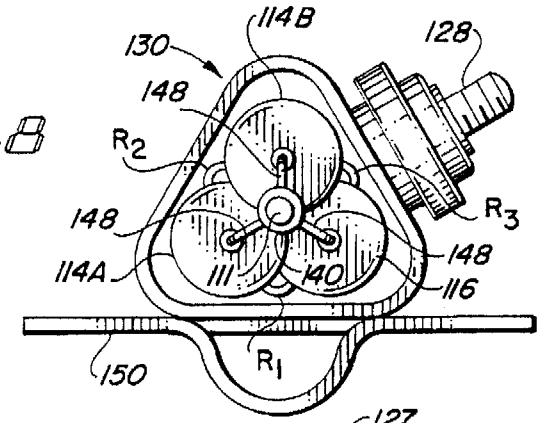
FIG. 8 is a schematic, end cross-section view representing an alternative embodiment to the detector shown in FIG. 7.
Figure 9:
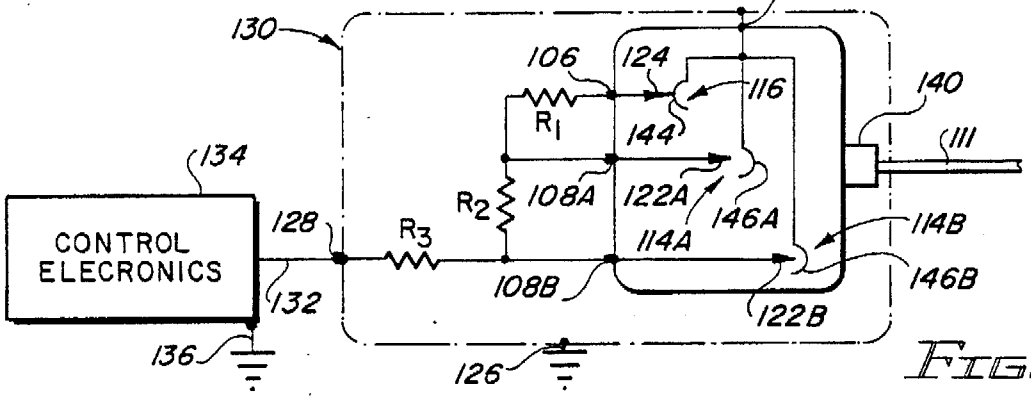
FIG. 9 is a schematic diagram of the embodiment of FIG. 8.

The arrangement represented schematically in FIGS. 8 and 9 is similar to that of FIG. 7 except that three individual switches are provided in order that the FIRE/OVERHEAT alarm may be separated to develop individual FIRE and OVERHEAT signals. In these figures, like elements are represented by the same reference numerals as in FIG. 7.

Thus FIG. 8 shows an outer container or housing 130 mounted against a bulkhead or support bracket 150. Within the housing 130 are three individual plenum switches: an overheat switch 114A, a fire alarm switch 114B and an integrity switch 116. These are connected by tubes 148 to a manifold 140 to which the sensor tube 111 is coupled. Three resistors $R_1$, $R_2$ and $R_3$ are connected in the circuit shown in FIG. 9 to develop different potentials at the output terminal 128 for the different closure conditions of the switches 114A, 114B, and 116 so that the associated control electronics stage 134 can provide the different signal indications of integrity—good/bad, overheat condition and fire as described hereinabove and, in addition, an indication of fault detection.

Figure 1:
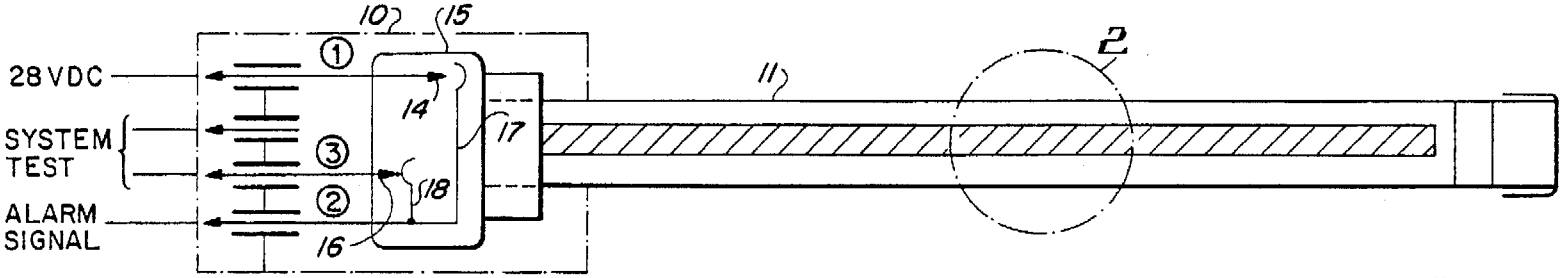
FIG. 1 (PRIOR ART)
FIG. 1 is a schematic diagram of one particular detector known in the prior art.
Figure 2:
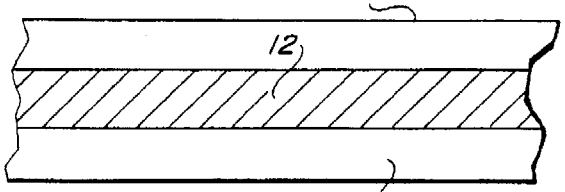
FIG. 2 PRIOR ART
FIG. 2 is an enlarged view of a portion of FIG. 1 taken substantially along the line 2—2.
Figure 3:
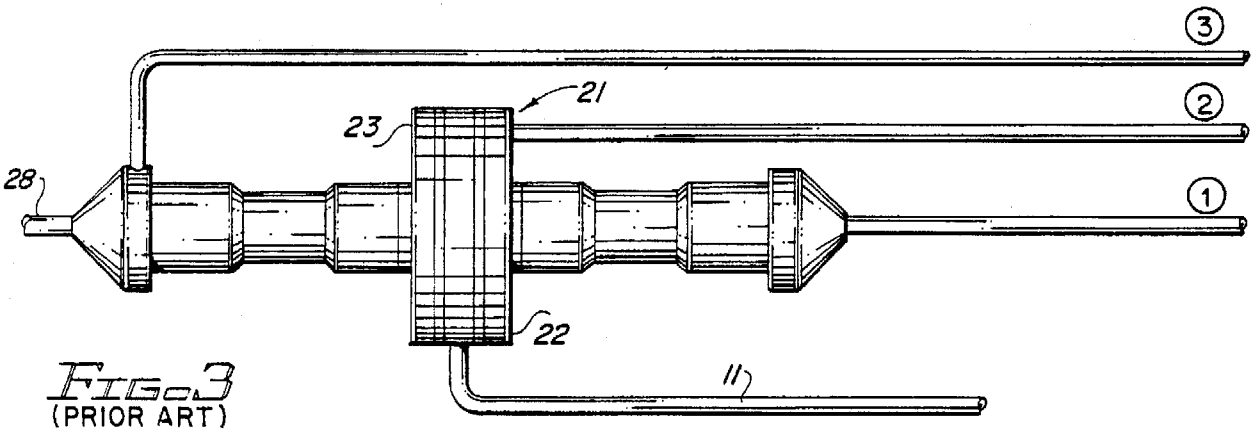
FIG. 3 (PRIOR ART)
FIG. 3 is an elevational view of a second prior art detector.
Figure 5:
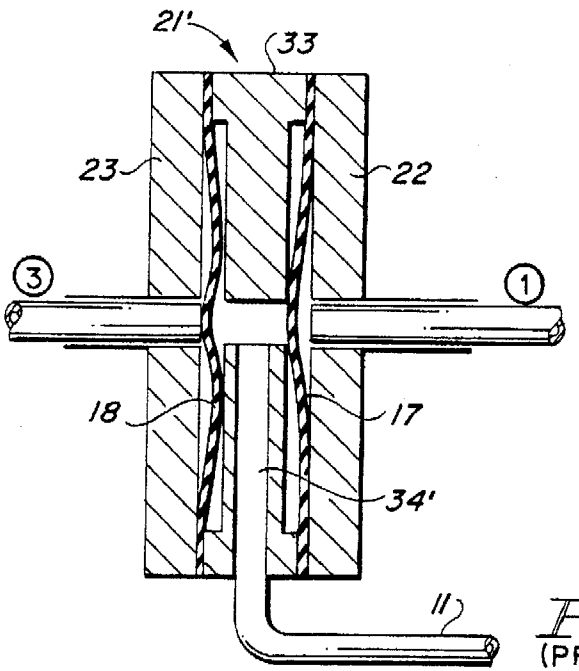
FIG. 5 (PRIOR ART)
FIG. 5 is a cross-sectional view showing an alternative embodiment to that of FIG. 4.
Figure 4:
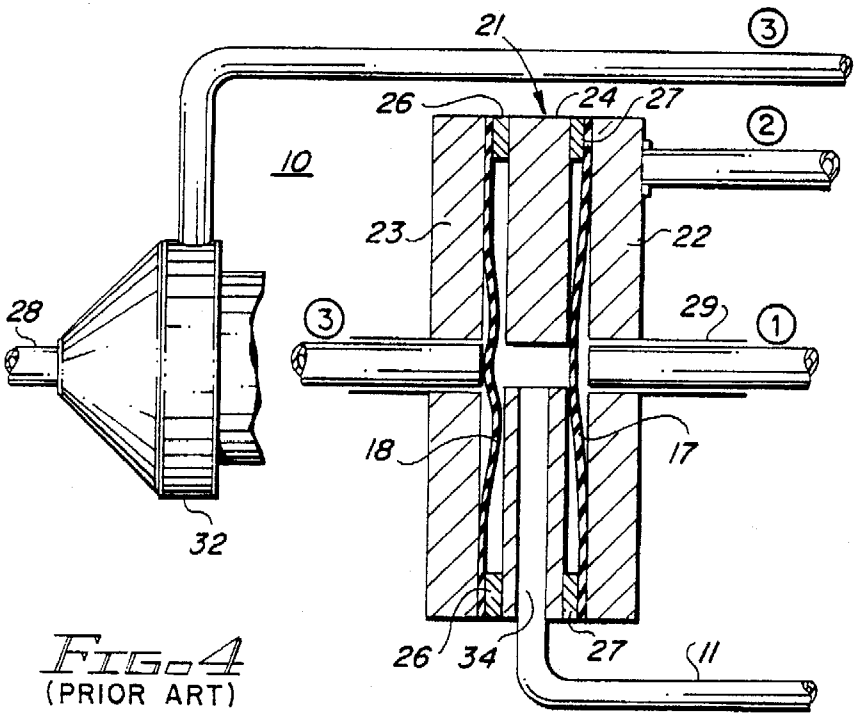
FIG. 4 (PRIOR ART)
FIG. 4 is a simplified cross-sectional view of FIG. 3, partially cut away.
Figure 6:
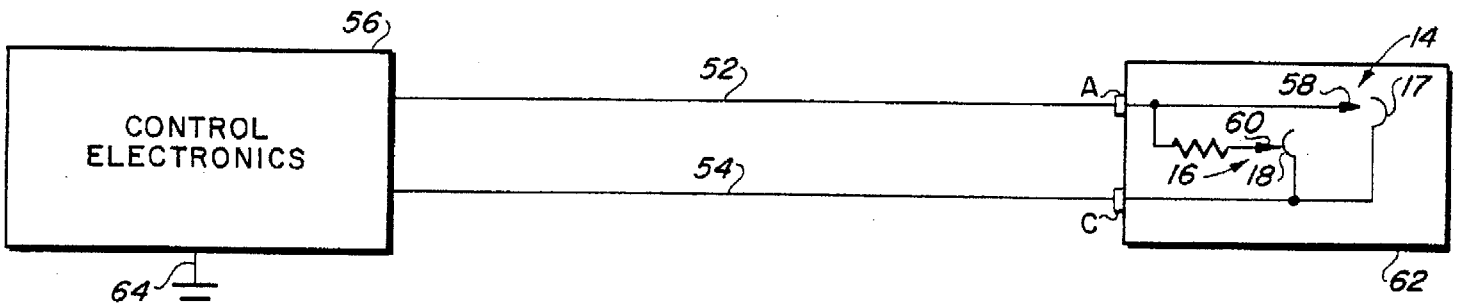
FIG. 6 (PRIOR ART)
FIG. 6 is a schematic diagram of still another arrangement of a detector known in the prior art.
Figure 10:
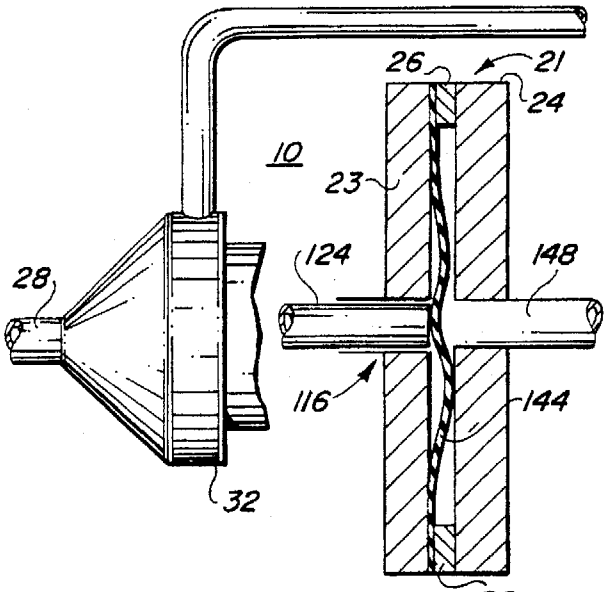
FIG. 10 is a schematic sectional view of one of the switches of the embodiment of FIG. 8.

FIG. 10 is a schematic view, in section, of a single switch as used in the embodiment of FIG. 8. Its structure corresponds to the left one-half of the switch module 10 shown in FIG. 4 and is described in connection therewith. Instead of the sensor tube 11 being attached at the side (the lower portion of FIG. 4), the tube 148 from the manifold 140 is shown in FIG. 10 as being connected coaxially to the switch.

Although there have been shown and described hereinabove specific arrangements of a pneumatic pressure detector for fire and ground fault detection in accordance with the invention for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the annexed claims.

What is claimed is:

1. Sensor apparatus comprising:

a dual switch assembly integrally formed in a self-contained module, said dual switch assembly having a first flexible diaphragm and associated first switch contact in a normally closed condition on one side of a central plenum and a second flexible diaphragm and associated second switch contact in a normally open condition on an opposite side of said plenum;

first and second electrical terminals mounted on the exterior of a first housing enclosing said module and connected respectively to said first and second switch contacts;

sensing means containing a pressurized gas coupled to said plenum to control the positions of said diaphragms relative to their respective associated switch contacts;

electrical circuitry associated with said module including:

a first resistor connected in circuit between said first and second electrical terminals;

a second resistor having one end connected to the juncture of said second terminal and said first resistor and the other end connected to a third terminal mounted on the exterior of a second housing enclosing said electrical circuitry and said first housing;

a control electronics stage remotely located from said module for providing indications of the circuit conditions of said electrical circuitry and said switch assembly;

respective ground connections from a ground reference means to said control electronics stage and to said second housing; and a single electrical conductor connected between said control electronics stage and said third terminal to enable control electronics stage to sense said circuit conditions including the occurrence of a ground fault.

2. The apparatus of claim 1 wherein said first housing is constructed of a conducting metal and said first and second electrical terminals are mounted in electrical isolation therefrom.

3. The apparatus of claim 2 wherein said first and second diaphragms are constructed of a conducting metal and are joined to said first housing in electrical circuit therewith.

4. The apparatus of claim 3 wherein said second housing is also constructed of a conducting metal and said third terminal is mounted in electrical isolation therefrom.

5. The apparatus of claim 3 wherein said first housing is mounted within said second housing in electrical contact therewith to establish an electrical circuit between the ground connection of the second housing and the flexible diaphragms of said switch assembly.

6. The apparatus of claim 1 wherein said first flexible diaphragm is adapted to withdraw from electrical connection with said first switch contact upon the reduction of pressure in said plenum and thereby establish an open circuit between said single electrical conductor and said ground connection to said second housing.

7. The apparatus of claim 1 wherein said second flexible diaphragm is adapted to move into electrical circuit connection with said second switch contact upon an increase in pressure in said plenum and thereby connect said second resistor in series circuit between said single electrical conductor and said ground connection to said second housing as the only resistor in said series circuit.

8. The apparatus of claim 7 wherein said control electronics stage is adapted to generate an alarm signal upon said second flexible diaphragm moving into electrical circuit connection with said second switch contact.

9. The apparatus of claim 1 wherein said control electronics stage is adapted to provide a signal indication of the failure of integrity of said sensing means.

10. The apparatus of claim 1 wherein said control electronics stage is adapted to provide a signal indication upon the occurrence of a short circuit between said single electrical conductor and ground.

11. Sensor apparatus comprising:

a multiple switch unit assembly mounted in an electrically grounded detector housing, each switch unit of said assembly having a fixed switch contact and a flexible diaphragm which is movable into and out of contact with said switch contact within a pressurizable chamber in response to pressure applied to said diaphragm;

each switch unit further having an outer terminal electrically connected to the fixed switch contact thereof;

sensing means containing a pressurized gas coupled to said switch units to pressurize said chambers in order to control the positions of said diaphragms relative to their respective associated fixed switch contacts;

electrical circuitry associated with said multiple switch assembly including:

a plurality of resistors interconnected in circuit with said switch unit outer terminals;

one of said resistors being the only connection to an external terminal mounted on said detector housing;

a control electronics stage remotely located from said multiple switch assembly for providing indications of the circuit conditions of said electrical circuitry and said switch units;

respective ground connections from a ground reference means to said control electronics stage and to said detector housing; and a single electrical conductor connected between said control electronics stage and said external terminal to enable the control electronics stage to sense said circuit conditions including the occurrence of a ground fault.

12. The apparatus of claim 11 wherein each switch unit includes a conducting metal enclosure on which the outer terminal corresponding thereto is mounted in electrical isolation therefrom.

13. The apparatus of claim 12 wherein each flexible diaphragm is constructed of a conducting metal and is joined to its corresponding enclosure in electrical circuit therewith.

14. The apparatus of claim 13 wherein said detector housing is also constructed of a conducting metal and said external terminal is mounted in electrical isolation therefrom.

15. The apparatus of claim 14 wherein said switch unit enclosures are mounted within said detector housing in electrical contact therewith to establish an electrical circuit between the ground connection of the detector housing and the flexible diaphragms of said switch units.

16. The apparatus of claim 11 wherein said assembly comprises three switch units pneumatically coupled to said sensing means.

17. The apparatus of claim 16 further including a manifold coupled between the sensing means and the switch units, each switch unit having a pneumatic tube extending from the switch unit to the manifold.

18. The apparatus of claim 16 wherein each of the switch units is adapted to provide an alarm signal for a different detected alarm condition of the sensing means.

19. The apparatus of claim 18 wherein the first of said switch units contains a normally closed switch and is adapted to provide an alarm signal in the event of a rupture of the sensing means.

20. The apparatus of claim 18 wherein the second of said switch units contains a normally open switch which is adapted to provide an overheat alarm signal upon the sensing means responding to a first preset temperature in the region being monitored.

21. The apparatus of claim 18 wherein the third of said switch units contains a normally open switch which is adapted to provide a fire alarm signal upon the sensing means responding to a second preset temperature in the region being monitored.

* * * * *